US009265680B2

(12) United States Patent
Sharps et al.

(10) Patent No.: US 9,265,680 B2
(45) **Date of Patent: *Feb. 23, 2016**

(54) SURGICAL TABLE

(71) Applicant: Operating Room Safety Enterprises, LLC, Berwyn, PA (US)

(72) Inventors: Lewis Sharps, Bryn Mawr, PA (US); Tony Sanchez, Narberth, PA (US); Peter Edwards, Glenrock, PA (US)

(73) Assignee: Operating Room Safety Enterprises, LLC, Berwyn, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/467,728

(22) Filed: Aug. 25, 2014

(65) Prior Publication Data

US 2014/0359941 A1 Dec. 11, 2014

Related U.S. Application Data

(63) Continuation-in-part of application No. 13/787,795, filed on Mar. 6, 2013.

(60) Provisional application No. 61/869,437, filed on Aug. 23, 2013, provisional application No. 61/607,253, filed on Mar. 6, 2012.

(51) Int. Cl.

| | |
|---|---|
| ***A61G 13/10*** | (2006.01) |
| ***A61G 13/06*** | (2006.01) |
| ***A61G 13/04*** | (2006.01) |

(Continued)

(52) U.S. Cl.

CPC ..... *A61G 13/104* (2013.01); *A61G 13/04* (2013.01); *A61G 13/06* (2013.01); *A61G 13/121* (2013.01); *A61G 13/122* (2013.01); *A61G 13/1245* (2013.01); *A61G 2007/0528* (2013.01); *A61G 2203/12* (2013.01)

(58) Field of Classification Search

CPC ..... A61G 2013/0054; A61G 13/04; A61G 13/08; A61G 13/0036; A61G 7/001; A61G 7/005; A61G 13/00; A61G 13/104; A61G 13/06; A61G 13/121; A61G 13/1245; A61G 13/122; A61G 2203/12; A61G 2007/0528

USPC ..... 5/601, 607, 608, 610, 611, 621–624

See application file for complete search history.

(56) References Cited

U.S. PATENT DOCUMENTS

| | | | |
|---|---|---|---|
| 3,202,218 | A | 8/1965 | Watts et al. |
| 3,238,539 | A | 3/1966 | Koch |

(Continued)

OTHER PUBLICATIONS

Allen Medical Systems, "Intraoperative Adjustment from Kyphosis to Lordosis", Announcement Allen Medical Systems, Feb. 6, 2006, pp. 1-4.

(Continued)

*Primary Examiner* — David E Sosnowski
*Assistant Examiner* — Eric Kurilla
(74) *Attorney, Agent, or Firm* — Volpe and Koenig, P.C.

(57) ABSTRACT

A surgical table including a central bottom portion is provided. The surgical table includes at least one first wheel adjacent a first end of the table, at least one second wheel adjacent a second end of the table, and a first stabilizing bar connected to the first wheel and the second wheel. The stabilizing bar is movably connected to the central bottom portion. The stabilizing bar is configured for coordinated movement of the wheels.

7 Claims, 16 Drawing Sheets

(51) Int. Cl.

| | |
|---|---|
| ***A61G 13/12*** | (2006.01) |
| *A61G 7/05* | (2006.01) |

(56) References Cited

U.S. PATENT DOCUMENTS

| | | | | |
|---|---|---|---|---|
| 3,584,321 | A * | 6/1971 | Buchanan | 5/601 |
| 3,750,659 | A | 8/1973 | Loomans | |
| 3,827,089 | A | 8/1974 | Grow | |
| 4,029,089 | A | 6/1977 | Mulholland | |
| 4,296,761 | A | 10/1981 | Tyo | |
| D307,055 | S | 4/1990 | Johnston | |
| 4,937,901 | A | 7/1990 | Brennan | |
| 5,131,106 | A * | 7/1992 | Jackson | 5/613 |
| D347,604 | S | 6/1994 | Ernst et al. | |
| D356,527 | S | 3/1995 | Wohnsen et al. | |
| 5,489,258 | A | 2/1996 | Wohnsen et al. | |
| 5,618,055 | A | 4/1997 | Mulholland | |
| 5,903,940 | A * | 5/1999 | Volker et al. | 5/611 |
| 6,154,901 | A | 12/2000 | Carr | |
| 6,421,854 | B1 | 7/2002 | Heimbrock | |
| 6,526,610 | B1 | 3/2003 | Hand et al. | |
| 6,640,363 | B1 * | 11/2003 | Pattee et al. | 5/601 |
| 6,678,907 | B1 * | 1/2004 | Voelker et al. | 5/611 |
| 6,681,423 | B2 * | 1/2004 | Zachrisson | 5/610 |
| 6,941,951 | B2 | 9/2005 | Hubert et al. | |
| 7,036,512 | B2 | 5/2006 | Harnois | |
| 7,137,160 | B2 | 11/2006 | Hand et al. | |
| 7,152,261 | B2 * | 12/2006 | Jackson | 5/600 |
| 7,197,778 | B2 | 4/2007 | Sharps | |
| 7,272,866 | B1 * | 9/2007 | Bradcovich | 5/601 |
| 7,343,635 | B2 * | 3/2008 | Jackson | 5/611 |
| 7,343,916 | B2 | 3/2008 | Biondo et al. | |
| 7,520,007 | B2 * | 4/2009 | Skripps | 5/621 |
| 7,520,008 | B2 | 4/2009 | Wong et al. | |
| 7,614,639 | B2 | 11/2009 | Tholkes et al. | |
| D612,942 | S | 3/2010 | Verdon-Roe | |
| 7,676,866 | B2 * | 3/2010 | Toms et al. | 5/611 |
| 7,739,762 | B2 * | 6/2010 | Lamb et al. | 5/618 |
| 8,056,163 | B2 * | 11/2011 | Lemire et al. | 5/611 |
| 8,424,133 | B1 * | 4/2013 | Rossi et al. | 5/601 |
| 2004/0172758 | A1 * | 9/2004 | Alakkat | 5/610 |
| 2005/0204472 | A1 * | 9/2005 | Gagneur et al. | 5/601 |
| 2006/0242765 | A1 | 11/2006 | Skripps | |
| 2007/0000055 | A1 * | 1/2007 | Donaldson | 5/607 |
| 2007/0174966 | A1 | 8/2007 | Lopez-Sansalvador | |
| 2007/0192960 | A1 * | 8/2007 | Jackson | 5/618 |
| 2007/0251012 | A1 * | 11/2007 | Hill | 5/624 |
| 2008/0256709 | A1 * | 10/2008 | Weiler | 5/611 |
| 2009/0209844 | A1 * | 8/2009 | Gagnon et al. | 600/411 |
| 2009/0282614 | A1 * | 11/2009 | Jackson | 5/601 |
| 2010/0024128 | A1 * | 2/2010 | Skripps | 5/621 |
| 2010/0192300 | A1 * | 8/2010 | Tannoury et al. | 5/607 |
| 2010/0223728 | A1 * | 9/2010 | Hutchison et al. | 5/610 |
| 2011/0099716 | A1 * | 5/2011 | Jackson | 5/607 |
| 2011/0107516 | A1 * | 5/2011 | Jackson et al. | 5/608 |
| 2012/0248331 | A1 * | 10/2012 | Iwata | 250/453.11 |
| 2013/0111666 | A1 * | 5/2013 | Jackson | 5/601 |
| 2013/0219623 | A1 * | 8/2013 | Jackson | 5/613 |
| 2013/0254992 | A1 * | 10/2013 | Jackson | 5/607 |
| 2013/0254993 | A1 * | 10/2013 | Jackson | 5/607 |
| 2013/0254994 | A1 * | 10/2013 | Jackson | 5/607 |
| 2013/0312181 | A1 * | 11/2013 | Jackson et al. | 5/601 |
| 2013/0312182 | A1 * | 11/2013 | Jackson et al. | 5/607 |
| 2013/0312188 | A1 * | 11/2013 | Jackson | 5/618 |
| 2014/0020179 | A1 * | 1/2014 | Brougham et al. | 5/601 |
| 2014/0020181 | A1 * | 1/2014 | Jackson | 5/607 |
| 2014/0208512 | A1 * | 7/2014 | Jackson | 5/608 |

OTHER PUBLICATIONS

"Radiolucent Wilson Frame", Orthopedic Systems, Inc. (OSI), Poster, 1998, 1 page.

* cited by examiner

SURGICAL TABLE

CROSS-REFERENCE TO RELATED APPLICATIONS

This application claims the benefit of U.S. Provisional Patent Application No. 61/607,253 filed on Mar. 6, 2012, U.S. Non-Provisional patent application Ser. No. 13/787,795 filed on Mar. 6, 2013, and U.S. Provisional Patent Application No. 61/869,437 filed on Aug. 23, 2013, the contents of which are herein incorporated by reference.

FIELD OF ART

This patent application is directed to a device, apparatus and system for positioning or lifting a patient for purposes of generally performing a medical procedure or surgery.

BACKGROUND

Positioning of a patient is an important consideration in surgery. Generally, surgeries and procedures performed to the posterior of a patient require the patient to be positioned in a prone position to provide access to a surgical site. Much of the positioning must be accomplished manually. This manual procedure can dislodge wires, tubes or other elements of the patient-monitoring equipment that is used during surgery, thereby risking disruption of the monitoring of the patient's condition.

Still another complication associated with manually positioning a patient onto an operating table for back surgery involves positioning the patient in proper alignment on the table. Some patients are placed on a "Wilson Frame" to properly align the back and thereby enhancing proper ventilation. The Wilson Frame allows the abdomen to hang pendulous and free. It is often difficult to manually manipulate the patient once placed onto the operating table to ensure proper alignment with the Wilson Frame underneath the patient.

Current devices, such as the Wilson Frame, used in operating rooms for supporting patients in a prone position with the abdomen free are passive devices designed only to provide support to the patient's trunk on the operating table during the surgery. It has been demonstrated that such passive frames can provide some changes in spinal configuration by virtue of the gravity effect. There is also danger in an abrupt movement of the patient's knees during the spinal procedure. Whereas studies have shown it is more preferable to raise the patient's legs very gradually; however, manually raising the legs in a gradual manner is difficult.

Other ancillary problems involve positioning of the head, chest, and legs with proper support and access for devices such as the endo-tracheal tube. Anthropometric considerations, such as patient size, including weight and width, cause the operating staff to ensure that proper padding and elevations are used to support the head, chest, and legs. It is not uncommon to find operating staff stuffing pillows or bedding underneath a patient to adjust for different anthropometric features of a patient.

There are dedicated-back-surgery systems on the market on which a patient can be positioned during a diverse set of orthopedic trauma, thoracic, and spinal surgery procedures. These devices, however, tend to be complicated and cumbersome to operate, and often subject the patient and operating staff to risk or death. For example, certain tables that allow tilting, or positioning, of the patient employ T-pins, which must be manually engaged and/or disengaged in order to position the device. There have been recent patient accidents following inadvertent and unexpected tilting of devices due to T-pin malfunction as a result of operator error. For instance, there are recent reports of injury-related incidents leading to product recalls of certain dedicated-back-surgery systems on the market today. A potential problem with these dedicated-back surgery systems is the potential for unexpected movement/tilting of the table, due to operator error of T-pin positioning. Also, patients and the equipment on which the patient is lying can drop several feet unto the floor due to staff error and the lack of redundant safety features, resulting in serious injury or death to the patient and/or operating staff. Such unanticipated movement of the patient during surgery can lead to paralysis or other catastrophic injuries to both the patient and operating staff.

Accordingly, there remains a need for equipment that may more safely and efficiently facilitate the positioning of a patient during spinal surgery.

SUMMARY

Described herein are an apparatuses, including systems and several mechanical elements, assemblies and sub-systems, for positioning, raising, inclining, declining, or lifting a patient for purposes of performing a medical procedure.

In one example, a positioning system may include motorized-vertical-lift columns and a lateral-tilt assembly that adjustably position an upper portion of the table into a plurality of positions, including: Trendelenburg, reverse Trendelenburg, up, down, lateral tilt, combinations of the aforementioned, and auto-level positioning. In one example, a control unit and user interface panel allows a user to operate and control the position of an upper-portion table (with respect to the floor).

In another example, the apparatus includes a motorized cantilever, facilitating extension of an upper portion of the table beyond its base. In another aspect, the lifting system includes lift columns that vertically extend or contract allowing for adjustability of the height of the table. The lift columns may extend or contract in tandem or individually, allowing the a patient resting on a surface of the table to be raised, lowered, tilted laterally (in tandem with the lateral-tilt assembly), placed in a neutral horizontal, inclined, or declined position.

In one embodiment, vertical-lift columns remain a fixed distance away from one another, each remaining generally perpendicular with respect to the floor. The table includes a base that may include a cross member, which joins the four vertical-lift columns.

In still another example, the surgical table may include a frame in the form of a platen for engagement and disengagement the table. The platen may include a single unitary-patient support such as for supporting the patient in a supine position. The platen may also include one or more configurable and removable patient supports, such for supporting the patient in a prone, lateral, or particular supine positions. The platen may engage or disengaged from an upper portion of the table. The platen, patient support surfaces and/or table may also include the ability to receive various equipment and devices attached thereto on as needed basis for specific-surgical procedures. Thus, table is modular allowing for different customized patient-support configurations and equipment for engagement to or disengagement therefrom.

Further details will become apparent with reference to the accompanying drawings and the following detailed description.

DETAILED DESCRIPTION

Terminology

Figure 1:
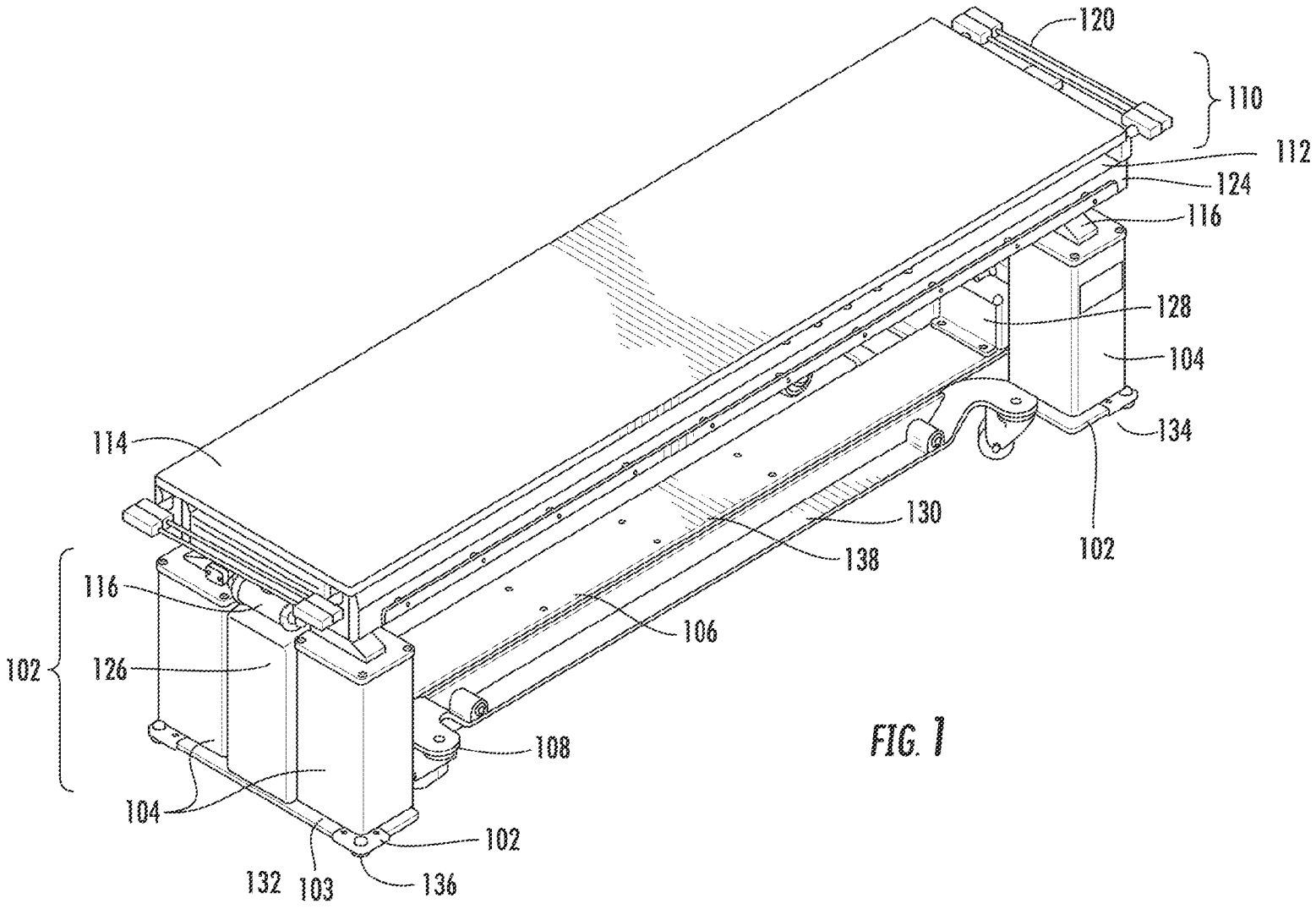
FIG. 1 shows a topside perspective view of one embodiment of the surgical table/patient-positioning apparatus, with a platen engaged with an interface.

The term "an embodiment," "one embodiment" "example" or similar formulations, means that a particular feature, structure, operation, or characteristic described in connection with at least one embodiment or example. Thus, the appearances of such phrases or formulations are not necessarily all referring to the same embodiment or example.

Furthermore, various particular features, structures, operations, or characteristics may be combined in any suitable manner in one or more embodiments or examples.

The term "including" means "including but not limited to" unless the context requires otherwise.

The term "platen" means an assembly having a framework and a patient-support area disposed within an area defined by the framework. While specific examples may refer to one or the other, it should be appreciated by those skilled in the art, that either is interchangeable.

The term "prone" refers to a patient lying face downward.

The term "supine" refers to a patient lying face upward.

The term "Trendelenburg" refers to the Trendelenburg position, in which the body is laid flat on the back (supine position) with the feet higher than the head by 15-30 degrees, in contrast to the reverse-Trendelenburg position, where the body is tilted in the opposite direction. It is a term referring to a standard position used in surgery.

Overview of Surgical Table with Positioning System:

Described is an apparatus and system for supporting and positioning a patient for purposes of generally performing a medical procedure including spinal surgery. The application is also directed to modules for supporting different portions of a patient's body, while lying in a prone, supine or lateral position during a medical procedure. In one embodiment, the surgical table comprises a patient-support surface, an interface, and a positioning system.

In one embodiment, the apparatus includes a surgical table configured to provide unrestricted access to the patient by medical staff, including direct access to the patient's head and neck region for the ease and safety of anesthesiology and other patient-monitoring equipment. In another embodiment, an upper portion of the surgical table (i.e., generally furthest from the floor) can be adjusted to various positions including, a lateral roll, Trendelenburg, reverse Trendelenburg, or combination of lateral roll and Trendelenburg.

Preferably, the patient-positioning apparatus is capable of at least 12 degrees of Trendelenburg and reverse Trendelenburg (incline/decline) positioning. The apparatus can preferably laterally roll either to the left or to the right of at least 19 degrees. The apparatus can preferably extend to approximately 38 inches high and can be lowered to approximately 22 inches, as measured from a top edge of the apparatus with no pad attached. In a neutral, uncantilevered configuration, the table is approximately 78 inches long and 21 inches wide. In an extended configuration, the table is approximately 110 inches long and 21 inches wide.

In yet another embodiment, the surgical table is height adjustable and capable of height adjustment. For instance, in one embodiment, the upper portion of the surgical table may be adjusted from a lowest height of about 20 inches to a maximum height about 45 inches measured from the ground inches from the floor.

The surgical table also allows complex angulation, using both lateral roll and Trendelenburg and reverse Trendelenburg simultaneously. The surgical table also provides cantilevered support during complex angulation. The piston 416 cantilevers the patient support assembly 402 to lengthen the frame. The cantilevering function provides the ability to move the table top. This allows a user to move a patient horizontally, such as toward imaging equipment or anesthesia equipment. The piston 416 can be any suitable actuator assembly, including a hydraulic linear actuator. Baffles can be provided around the extended portions of the frame to prevent an object from getting pinched between the portions of the frame when the frame is going from a cantilevered position to an uncantilevered position. The baffles prevent a user's fingers, tubing, patient extremities, or other objects from getting caught or pinched between the components of the table.

Exemplary Surgical Table & Patient Positioning Apparatus

An example surgical table 100 is depicted in FIG. 1. Table 100 is generally rectangular in shape, and includes a base 102. Base 102 includes vertical-lift assemblies 104 joined together by an I-shaped member 106, which is essentially parallel with the floor. A central portion 138 of member 106 generally bisects table 100 extending longitudinally between a head end 132 and foot end 134 of table 108.

Each pair of vertical-lift assemblies 104 are positioned at head end 132 or a foot end 134 of table 100, respectively. Attached to member 106 are two pairs of wheels 108 located bilaterally on each side of cross member 106, each pair of wheels 108 spaced apart from each other; toward head end 132 and foot end 134 of table 108.

Figure 6:
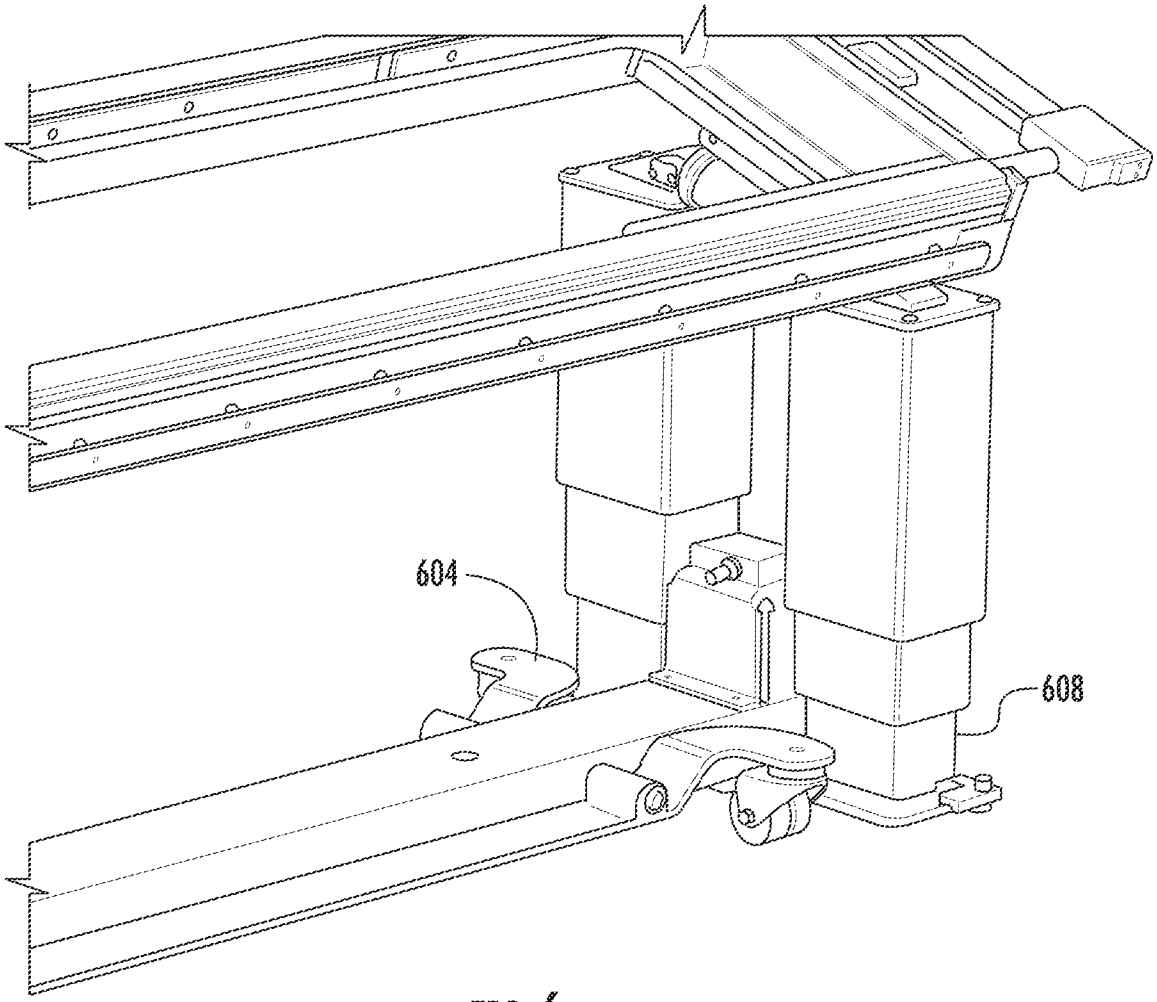
FIG. 6 shows a partial view of the wheel system 604, with the wheel partially engaged and extended away from the base 608 of the apparatus. When the wheels are fully engaged and extend downward into the floor, the base 608 of the apparatus is raised off the ground so that the apparatus is supported by the wheels 604.
Figure 7:
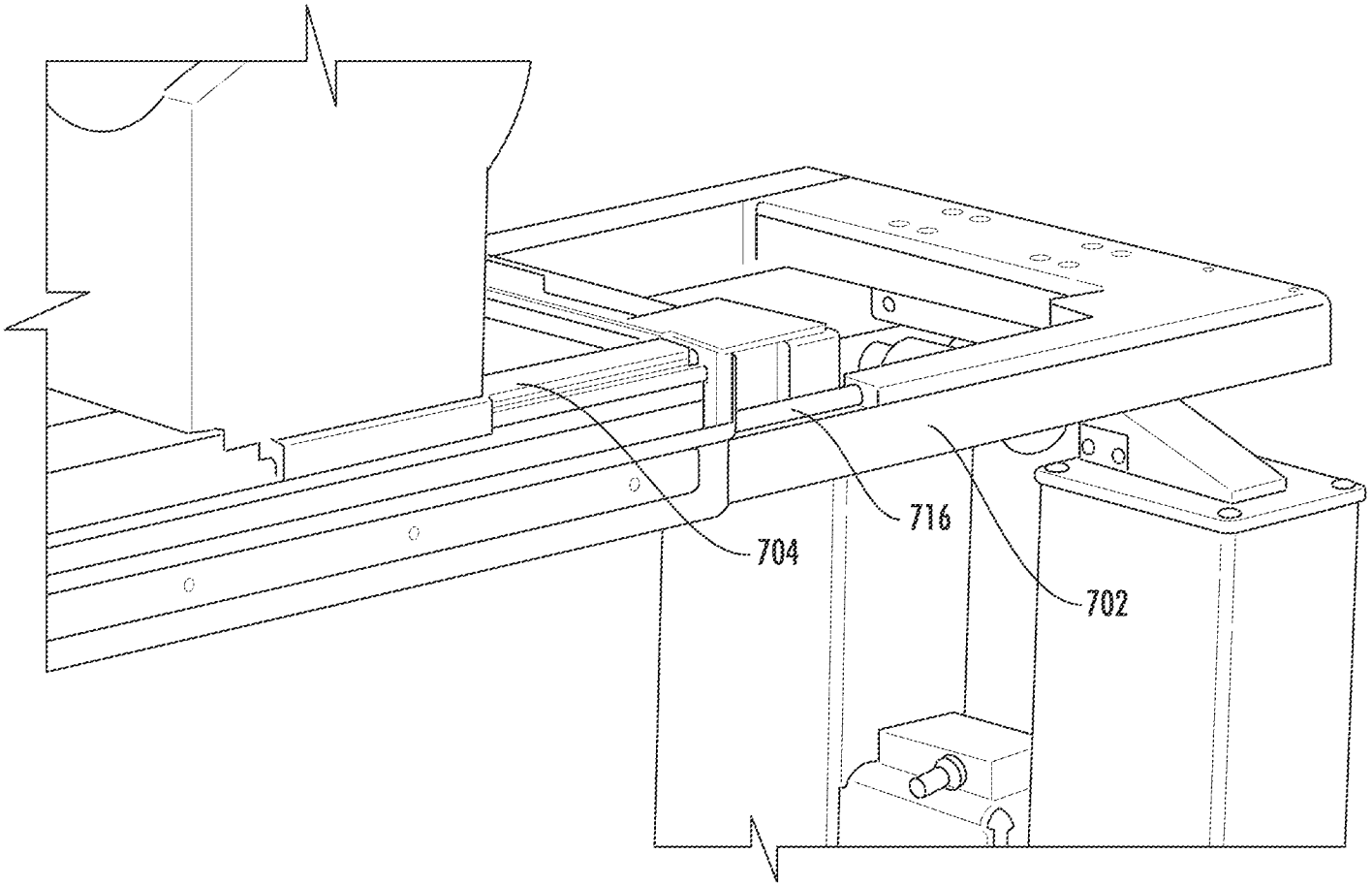
FIG. 7 shows a partial view of the piston 716 that powers the cantilever of the apparatus.

In one example, the wheels 108 extend or retract. When wheels 108 are fully extended and engaged they contact the floor, and a lowest portion 103 of base 102 (with respect to the ground) is raised from the floor, and table 100 is fully supported by wheels 108. Conversely, when wheels 108 are retracted and disengaged (depicted in FIG. 6) from the floor, a lowest-portion 103 of base 102 of the table 100 rests on the floor thereby effectively anchoring table in a stationary position. As appreciated by those skilled in the art, rubber bumpers 136 or other-suitable friction inducing devices/materials may be fastened to a lowest-portion 103 of base 102. For example, these bumpers 136 may reside underneath each corner of base 102.

A stabilizing bar 130 on each side of cross member 106 connects wheels 108. Stabilizing bar 130 maintains the position of wheels in a fixed direction with respect to each other when transitioning from engaging and disengaging the floor. Patient support assembly 110 includes an interface 112 and a patient support 114. Patient support assembly 110 provides a surface for receiving and positioning a patient for a medical procedure. As described in more detail below, the patient support assembly can be of various configurations depending on the desired position of the patient and the procedure to be performed. While a platen is shown in FIG. 1, other structural elements may be incorporated as part of the patient support 114 without.

Figure 10:
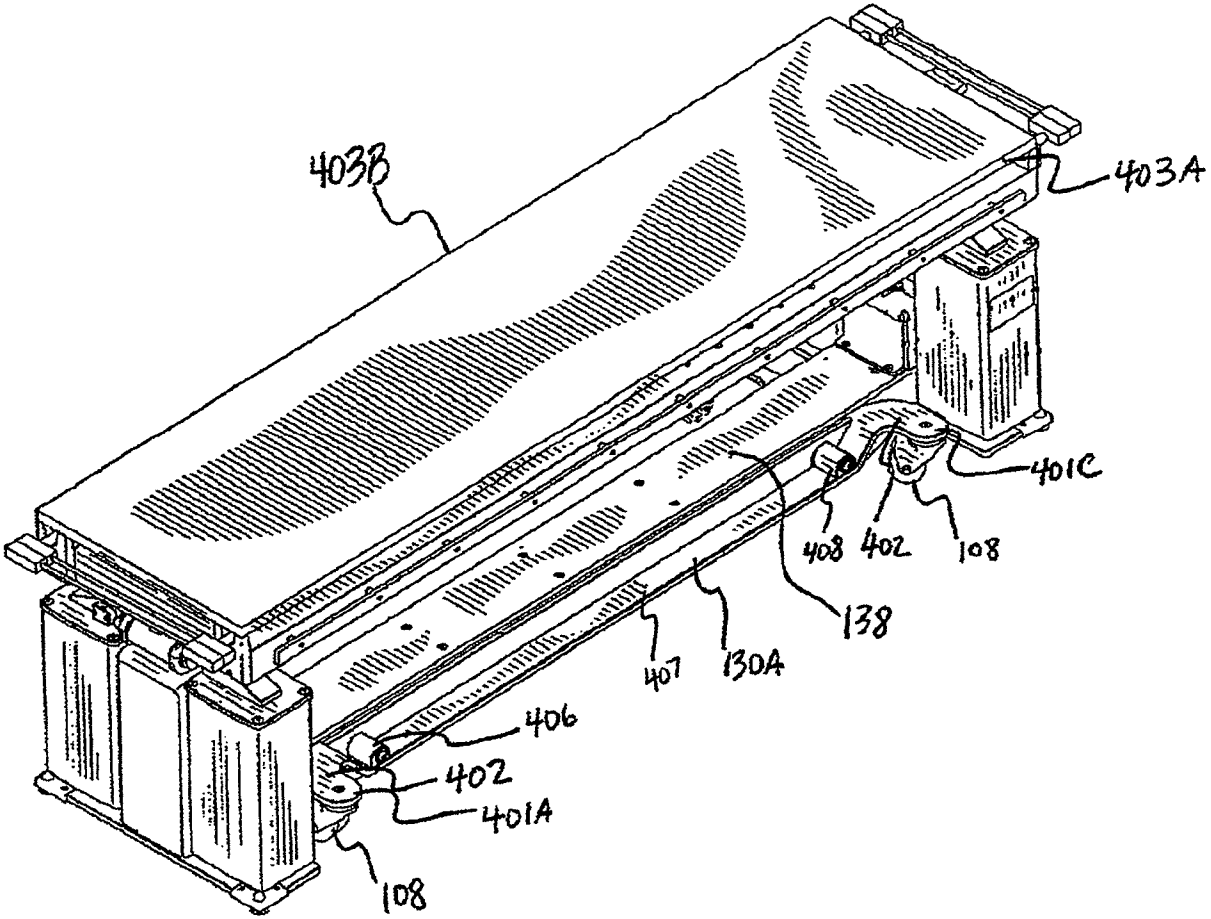
FIG. 10 shows a topside perspective view of one embodiment of the surgical table.
Figure 11:
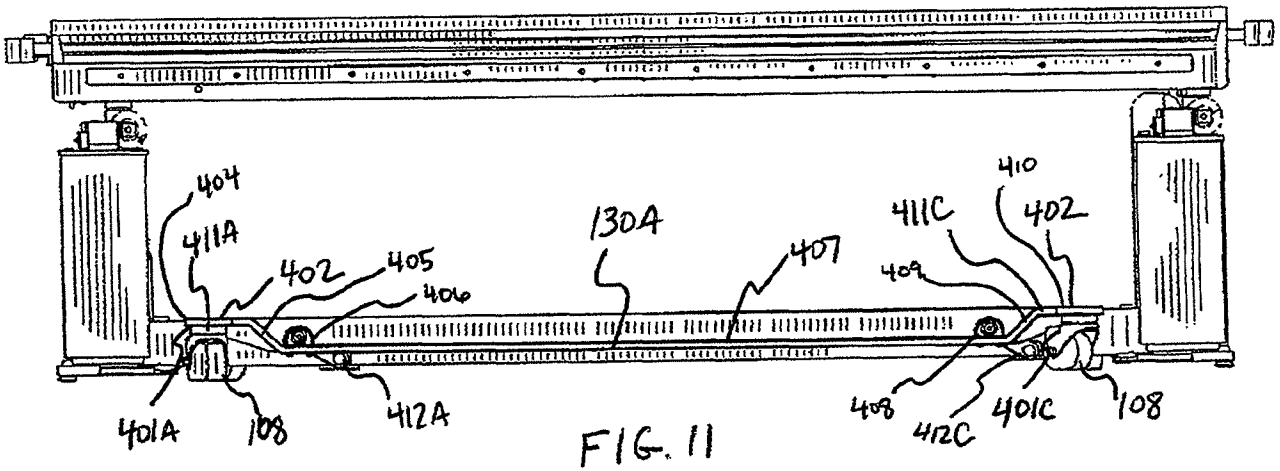
FIGS. 11 and 12 show side views of the surgical table.
Figure 12:
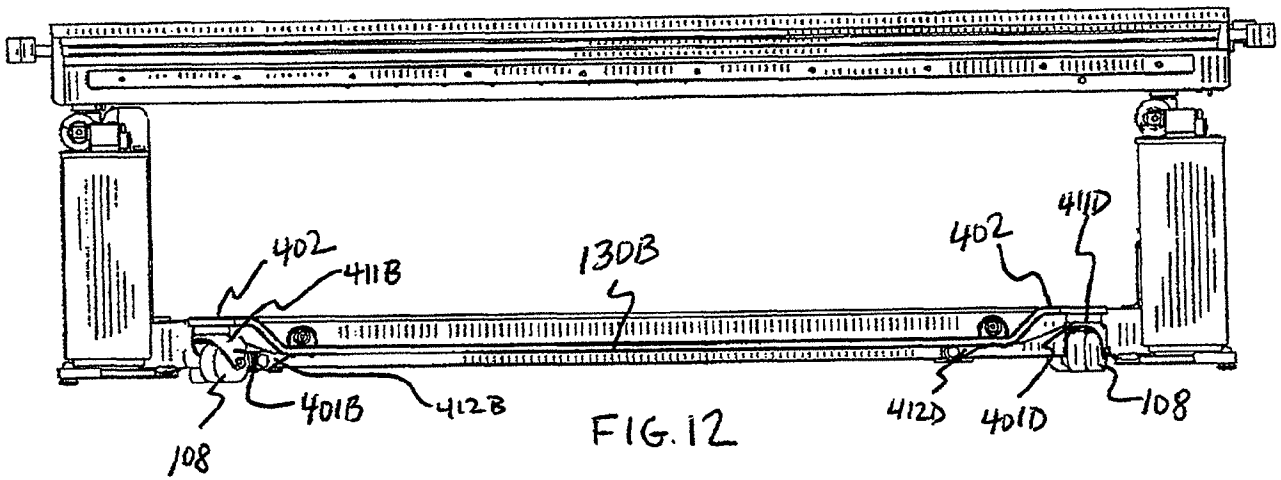

In one embodiment, shown in FIGS. 10-12, wheels 108 are provided with four casters 401 (separately 401A, 401B, 401C, 401D), with the casters 401 having a generally flat horizontal upper surface 402. On each side 403A, 403B of the table 100, stabilizing bars 130 are provided. Stabilizing bars 130A, 130B run longitudinally along the sides 403A, 403B of the table. Referring to FIGS. 11 and 12, each stabilizing bar 130 preferably includes a first end 404, a first sloped portion 405, a first attachment portion 406, a central portion 407, a second attachment portion 408, a second sloped portion 409, and a second end 410.

As shown in FIGS. 11 and 12, stabilizing bars 130A, 130B mechanically connect and are positioned between first end casters 401A, 401B and second end casters 401C, 401D. As shown in FIG. 11, stabilizing bar 130A runs between and connects first end caster 401A and second end caster 401C. As shown in FIG. 12, stabilizing bar 130B runs between and connects first end caster 401B and second end caster 401D.

First end 404 and second end 410 of each stabilizing bar 130A, 130B preferably slope upwardly from the central portion 407. First end 404 and second end 410 of each stabilizing bar 130A, 130B preferably each include a generally flat horizontal caster receiving portion 411A, 411B, 411C, 411D. Casters 401A, 401B, 401C, 401D, are attached to respective caster receiving portion 411A, 411B, 411C, 411D.

Each stabilizing bar 130A, 130B is movably attached to opposite sides of central portion 138 via height adjustment extension pieces 412A, 412B, 412C, 412D. Height adjustment extension pieces 412A, 412B, 412C, 412D may be provided as generally flat metal flanges, with openings at each end for receiving, for example bolts. Height adjustment extension pieces 412A, 412B, 412C, 412D movably attach each stabilizing bar 130A, 130B to opposite sides of the central portion 138, whereby each stabilizing bar 130A, 130B can be raised or lowered with respect to the central portion 138.

The movable connection of the stabilizing bars 130A, 130B to the central portion 138 allows casters and wheels to be raised to a raised position, or lowered to a lowered position. To move table 100, each stabilizing bar 130A, 130B is lowered so that wheels 108 contact the floor, allowing for rolled movement of the table 100. In a preferred embodiment, all four casters are pushed downward simultaneously. When the table 100 is in a desired position, each stabilizing bar 130A, 130B is raised, disengaging the wheels from the floor, or positioning the wheels wherein each of the wheels only slightly touches the floor, or where the wheels are about in substantially the same plane as the lower portion of the table. It is contemplated that the stabilizing bars 130A, 130B can be raised and lowered by electronically controlled motors, and controlled electronically by a control panel.

Preferably, each stabilizing bar 130A, 130B moves, with respect to the central portion 138, approximately the distance of the height of the casters and wheels. Preferably, at least one locking mechanism is provided to maintain each stabilizing bar 130A, 130B in the raised position and/or the lowered position, or both positions. Preferably, a locking mechanism is provided that can be engaged, disengaged or otherwise actuated by the foot of a person using the table, for ease of use.

By connecting the respective front and rear casters, as previously described, the stabilizing bar acts to prevent "wheel wobble" when the table is moved, raised, or lowered. Because each caster is attached to each end of the respective stabilizing bar, the wheels are maintained in essentially the same plane when being raised or lowered. Thus, the transition from the raised position to the lowered position is coordinated between attached first and second casters. Further, the casters and wheels can automatically lock if a user attempts to manipulate the table for use during surgery.

The stabilizing bars effectively act as components of a "parallel link machine." The parallel link function refers to the ability of two separate components to move in parallel with one another via a link, such as a single actuating device. An actuator may be provided to actuate a cam to move the stabilizing bars and ensure that the wheels at the head and foot ends of the table move in a synchronized, parallel way. The stabilizing bars are moved in unison to ensure that all of the wheels and casters attached to each stabilizing bar engage the floor at the same time. Additionally, when the wheels are retracting, the actuator ensures that the bottom surface of the table engages the floor evenly.

Interface 112 generally comprises a rectangular frame with a head end and a foot end, and optionally comprises a slidable track, or rail, system 124. In one embodiment, the interface is configured with a track system 124 for facilitating movement of the patient support along the surface of the apparatus. Patient support assembly 110 is attached to the base by a pair of positioning assemblies 116.

In one embodiment, a power unit 126 and control panel 128 are integrated into the base of the table, although other arrangements of the power unit and control panel are envisioned, such as auxiliary units.

Patient Support Assembly

Interface 112 is configured for with engagement means for reversible attachment of a patient support 114. In one embodiment patient support 114 is secured to interface 112 by attachment means such as a latch or other locking system. In another embodiment, patient support 114 is secured to interface 112 through a magnetic connector system. In yet another embodiment, patient support 114 connects to interface 112 by a "snap and release" attachment system.

Figure 8A:
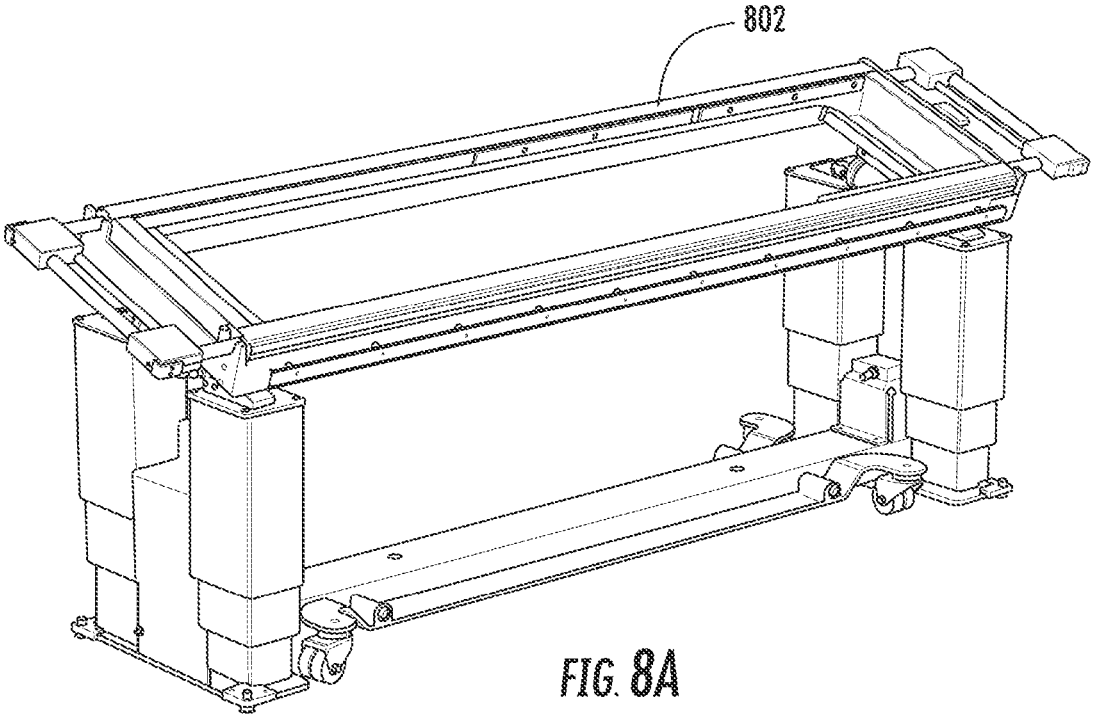
FIG. 8A shows a side view of the surgical table apparatus with the patient support platen 802 positioned in a lateral tilt.
Figure 8B:
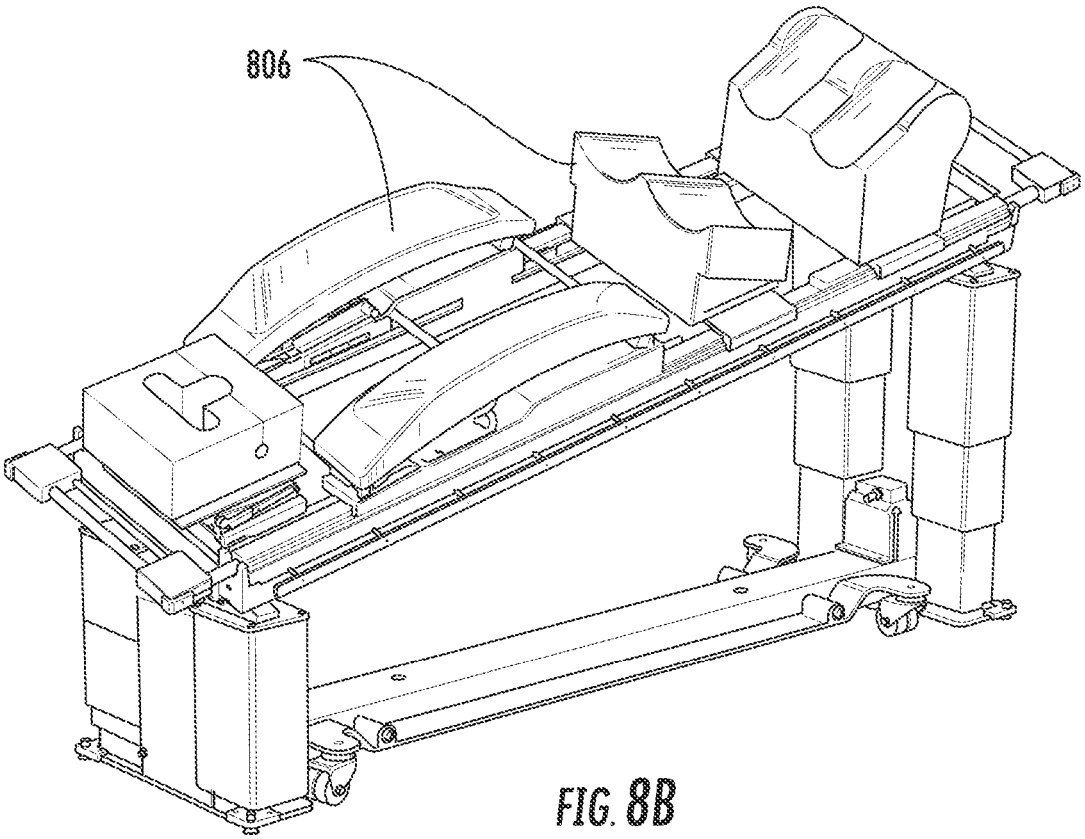
FIG. 8B shows a side view of the surgical table apparatus equipped with various embodiments of patient supports 806 connected.
Figure 8C:
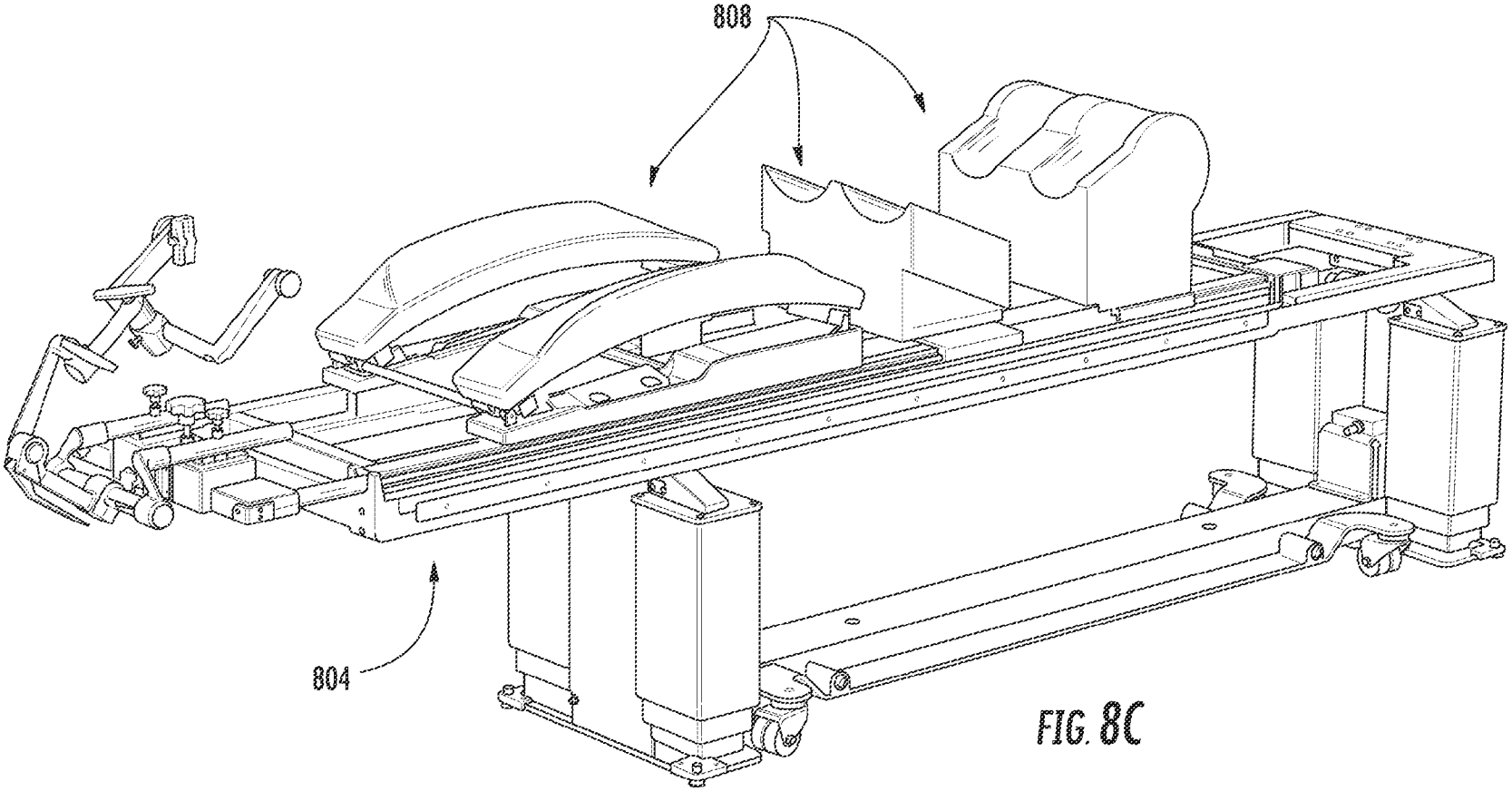
FIG. 8C shows a side view of the surgical table apparatus equipped with a Wilson frame-style support system 808.

FIG. 1 shows patient support 114 as a single rectangular platen. In another embodiment, a platen may be comprised of longitudinally-expanding plates or articulated plates, or includes of a framework suitable for supporting individual patient support members (see FIGS. 8A, 8B and 8C for examples). In another embodiment, platens are generally planar and may be constructed of any suitable radiolucent material, such as carbon fiber, or any suitable non-radiolucent materials such as aluminum. In general, platen is generally commensurate in shape and length with an average operating room table surface. It will be appreciated by those skilled in the art that the length and width may vary depending on the implementation and the size of patients.

Patient Support Modules

Patient support 114 may include different interchangeable modules that can be connected in various ways with interface 112, depending on the preference of the operating staff, size of the patient, and type of operation being performed. Thus, it is possible for operating staff to efficiently swap in or out different patient-support modules needed for a particular operation.

For example, occipital padding and a leg bolster may be placed on a planar surface of the platen to support the head and legs respectively when a patient lies on his back on the surface of the platen. Other patient-supports include as examples: a head-support assembly, a torso support, leg pads that support the patient while lying in a prone position. Torso support and leg pads can be fastened to the platen, and can move longitudinally to adjust for different sized patients. In one example, torso support consists of two pads in the general shape of Wilson-styled chest frame, which supports the outer portions of the side of patient. These pads extend from the upper thighs to the shoulders of a patient. The height of the center portion of the torso support is adjustable by a manual or powered crank system. (See FIG. 8 For examples of patient supports.)

Wheel System

Adjustable casters or wheels, 108 attached to the cross member provide mobility to the surgical table. A pair of casters 108 is attached at each of the head end and foot end of the table base along the cross-support member, on each side of the cross-support member. The wheels of the casters are contained with the footprint of the table, and therefore out of the line of movement by medical personnel.

Figure 13:
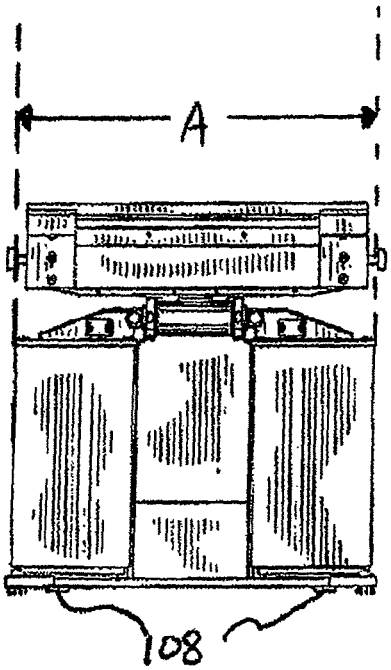
FIGS. 13 and 14 show end views of the surgical table.
Figure 14:
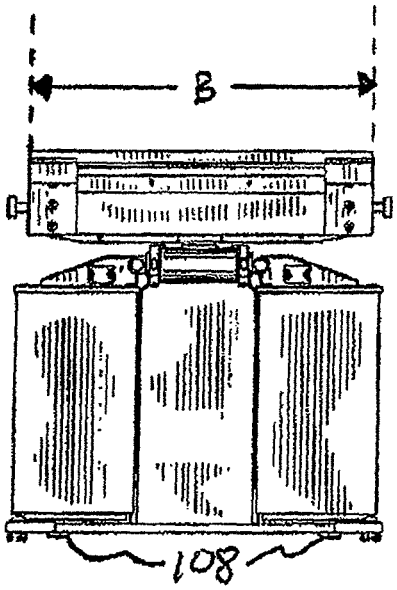

Because space is limited in any operating room area, it is important that operating room equipment have a limited footprint. Preferably, the casters of the present invention are positioned within the operating table surface. Considering the outer area of the table as a designation "A" in FIG. 13, in an embodiment, casters are each positioned within the bounds of "A". In another embodiment, casters are positioned underneath the operating table surface, within bounds "B" as shown in FIG. 14.

This arrangement provides not only a limited footprint for the table, but also positioned the casters and wheels so that it is less likely that operating room personnel trip or get otherwise caught on the casters and/or wheels. In addition, with such an arrangement, operating room cords, extensions, or tubing is less likely to get snagged on the casters or wheels. Further, the inboard wheels allow a gurney to "dock" directly adjacent, or shoulder-to-shoulder with the table. This facilitates safe and easy patient transfer between the gurney and table. Existing tables with outrigger or winged wheel configurations cannot be "docked" in this manner. There is typically a six to eight inch gap for existing tables between the gurney and table which the patient must be transferred across.

Due to the configuration of the support columns, the table is compatible with a wide range of C-arm diagnostic scanning devices and provides nearly head-to-toe imaging capability. The table provides approximately 64 inches of unobstructed C-arm space between the head end support and the foot end support. The ability to cantilever allows head to mid-torso imaging via a C-arm diagnostic scanning device. The configuration of the support columns, along with the cantilevering ability provides the ability for nearly head-to-toe imaging.

When the casters 108 are engaged, they rotate out from the cross-support member to a position in which the wheels are in contact with the floor. As the casters 108 rotate out and away from the cross-support member and become flush with the floor, the base of the table is raised from the ground. The table is made portable and can then be wheeled-about as are other portable transport devices, such as a gurney.

In one embodiment, casters 108 are interconnected via a cross-bar comprising a shaft that is configured within the cross-support member and runs the length of the cross-support member. In one embodiment, the wheels/casters are interconnected for coordinated movement. Movement of the shaft of the cross-bar transfers movement in turn to the wheels.

In one embodiment, the casters 108 are controlled electronically, but can also be operated manually. A motorized break (not shown) locks and unlocks the wheels. A safety feature comprises a lockout feature. The safety feature is configured such that when the wheels are engaged, the function of the positioning assembly is locked in the neutral position, thereby preventing inadvertent tilting, cantilever, Trendelenburg movement of the table. Only when the wheels are in the resting position—or collapsed—will the table be permitted to move laterally, cantilever, Trendelenburg or reverse Trendelenburg. (Figs. show the wheels in the neutral and extended (engaged) position.)

An optional handle 120 is located at either, or both of, the head end or foot end of the interface. In one embodiment, the leveling system 122 comprising a pair of adjustable leveling feet underlies the lift assemblies of the base at each end. Each leveling foot is independently adjustable, such as by a screw mechanism, in order to level and thereby stabilize the table against the surface on which the table resides.

In one embodiment, the table is configured with an auto-leveling feature, which automatically adjusts leveling feet until the table is in a level position against the surface on which it rests.

Various controls are provided to control the various functions of the table, such as lifting and positioning. In one embodiment, two hand-held controls, or handsets are provided. A first hand-held control, or handset, is positioned at the head end of the patient support assembly, for easy access by medical personnel such as anesthesiology personnel. A second hand-held control can remain in the sterile field for use throughout the surgical procedure. In another embodiment, a foot control is provided.

Patient-Positioning System:

In one embodiment, the surgical table comprises a patient-positioning system configured to lift and/or tilt the head or foot end of the patient independently from each other, such as in Trendelenburg or reverse-Trendelenburg positions, and is also configured to angle the patient laterally.

Figure 2A:
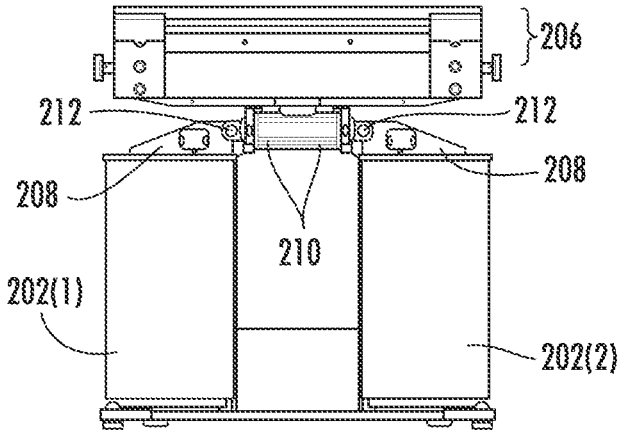
FIG. 2A shows a front-end view of one embodiment of the patient-positioning apparatus, showing a cross coupler mounted to the top end of lift columns.
Figure 2B:
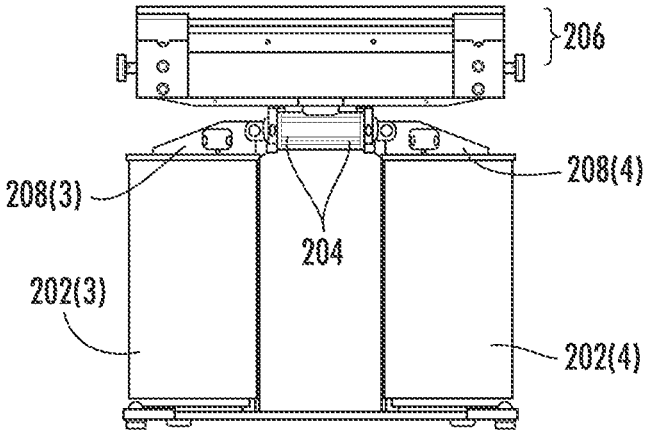
FIG. 2B shows a back-end view of one embodiment of the patient-positioning apparatus with a cross coupler mounted to the top end of lift columns.

FIGS. 2A and 2B show a front-end and/or back-end view of a patient-positioning system 200 comprising a vertical-lift assembly 202 comprising vertical lift columns 202(1), 202(2) coupled to a position assembly 204. A patient positioning system is located at each end—head end and foot end—of the surgical table. Vertical-lift assembly 202, and embodiments described herein, are typically electrically-powered lift columns, but it is appreciated by those skilled in the art having the benefit of this disclosure, that these lift columns may be powered by any suitable means including but not limited to hydraulics and pneumatics. Vertical-lift assemblies 202 are located at distal ends of the cross-support member (cross-support member not shown in FIG. 2). In one embodiment, vertical-lift assemblies are columns configured to extend and retract vertically, via telescoping members aligned within the columns, allowing for adjustment in height. As the height of the column is adjusted, so is the height of the patient support assembly 206. In one embodiment, the height of both vertical-lift columns 202(1), 202(2) move in unison. Vertical-lift columns 202 may incorporate actuators (not shown) that telescopically expand and contract each column to control their height. In one example, the lift columns include four separate actuators that independently effect movement. Each actuator may operate to increase or decrease the height of each column in unison, or independently from each other, so as to provide various angled positioning of the patient support assembly 206.

Each of the two positioning assemblies 204 interconnects the lift-columns 202 to the patient support assembly 206. Each distal attachment end 208 of the positioning assembly 204 is securely fastened/mounted to the top of lift-columns 202 by suitable attachment means such as screws or bolts. A cross coupler 210 bridges each distal attachment end and in turn is attached to the interface of the patient support assembly 206 (attachment point not shown in FIG. 2). A cross coupler arrangement is positioned at the head end and foot end and is configured to couple the actuators to the lift columns together laterally at each end of the table.

Cross coupler 210 comprises a cylindrical member that houses one or more independent rods 216 that move (expand or compress) in response to adjustments in the lift-columns. In one embodiment, the rods 216 are attached to the attachment ends in a tire wire fashion, similar to an eye bolt or pin that is configured to pivot or rotate.

Figure 2C:
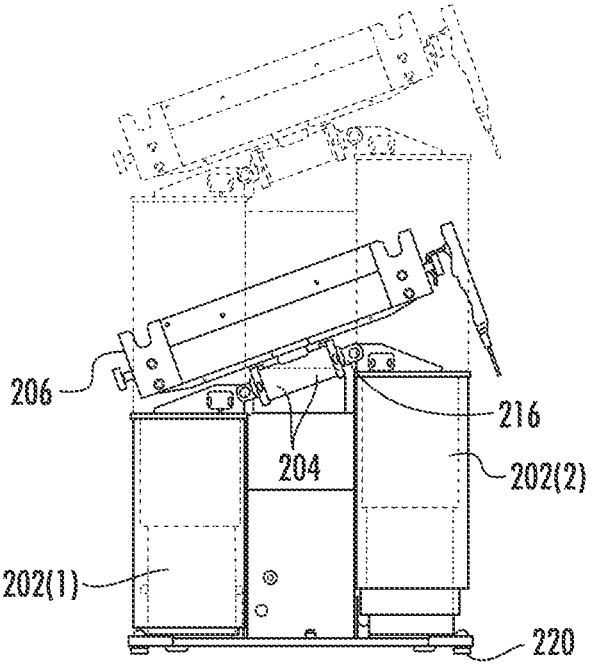
FIG. 2C shows a front-end view of the positioning system in a lateral tilt. In a lateral tilt, a set of rods housed in the cross coupler are engaged in a push-pull action, thereby facilitating the tilt of the interface of the apparatus.
Figure 2D:
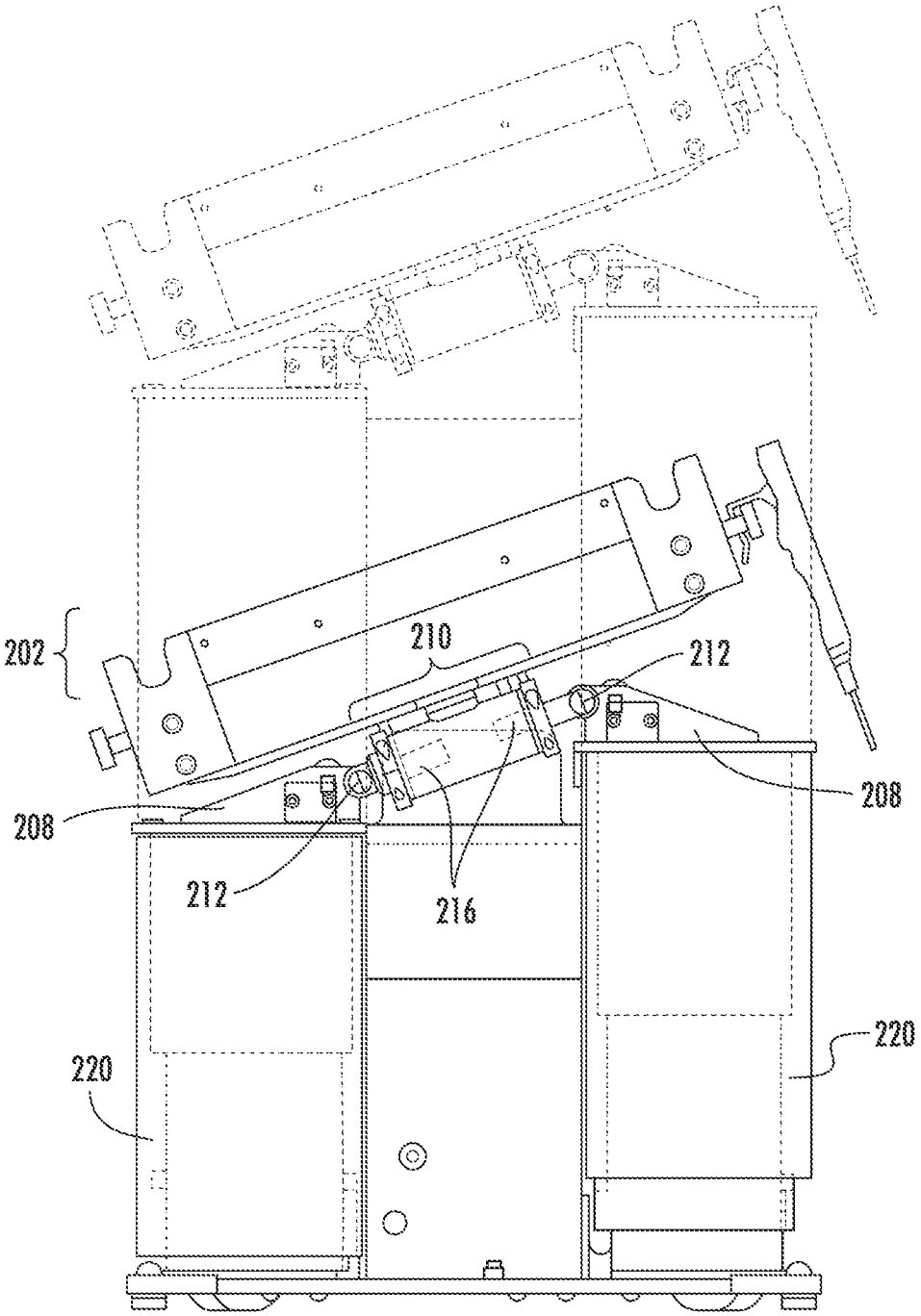
FIG. 2D shows a perspective view of one embodiment of the cross coupler. Rods housed in the cylindrical coupler are engaged in a push-pull action.
Figure 3A:
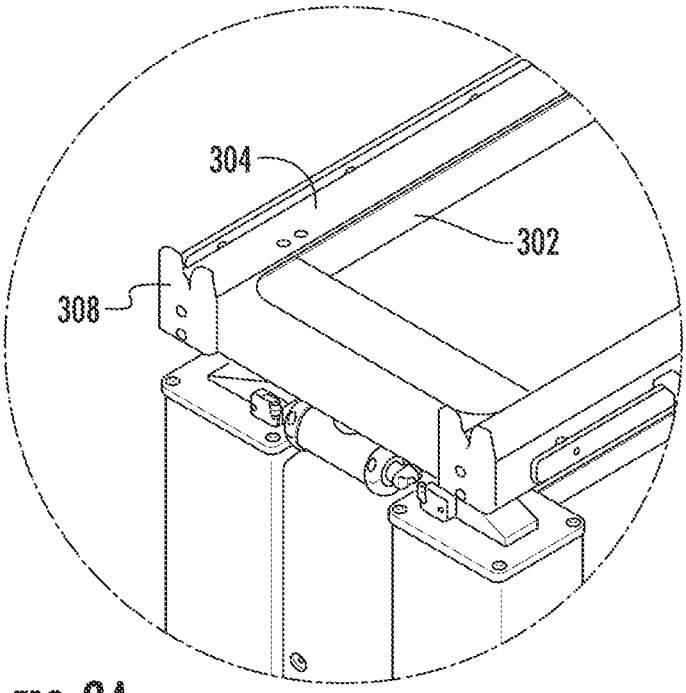
FIG. 3A shows a top-down perspective view of an interface at the head-end. In view are the receiving ends (shown as grooves) of the interface, where the patient support can snap into position.
Figure 3B:
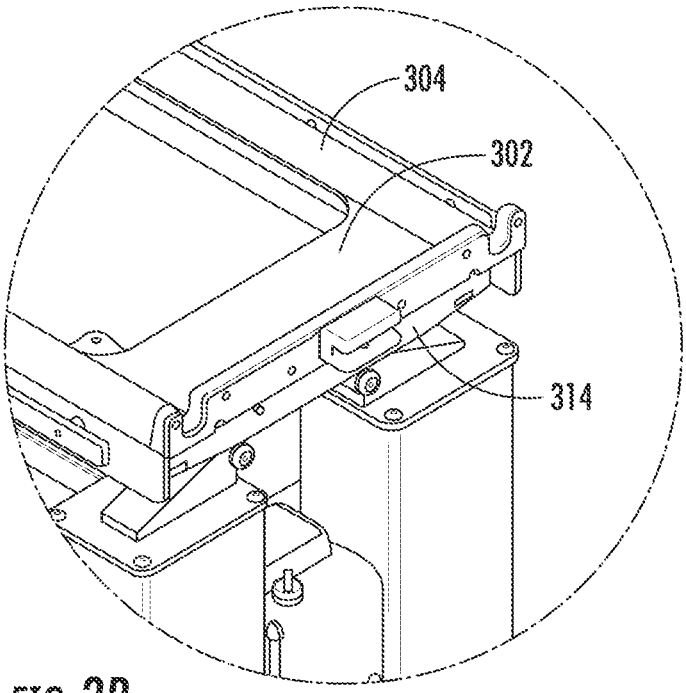
FIG. 3B shows a top-down perspective view of a patient support assembly at the foot end, with a platen frame in position. A latch is also shown.
Figure 3C:
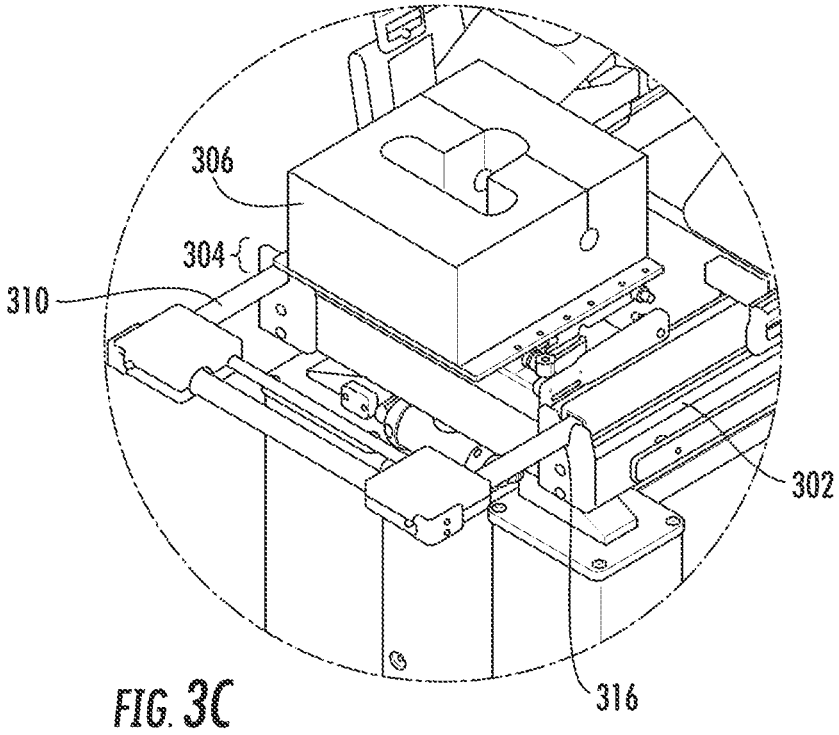
FIG. 3C shows a top-down perspective view of a patient support assembly at the head end; a head support is attached to the interface.
Figure 3D:
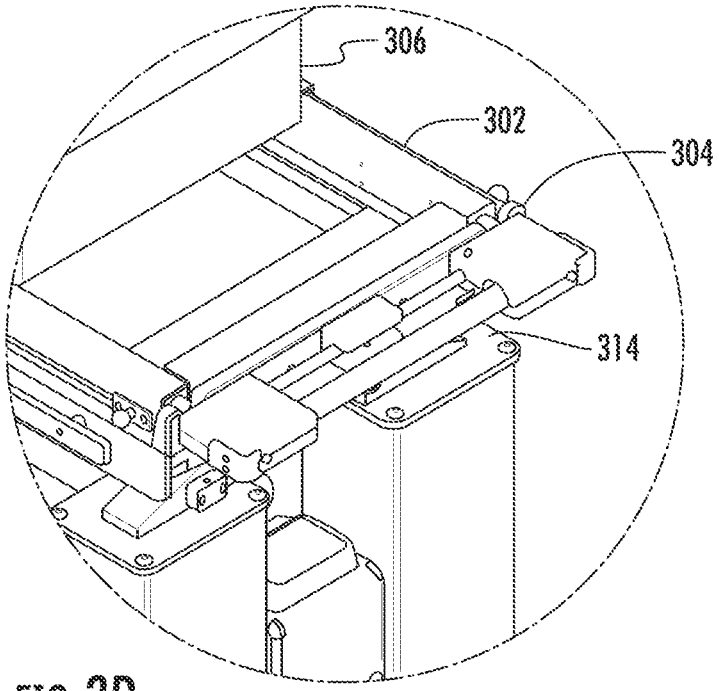
FIG. 3D shows a top-down perspective view of a patient support assembly at the foot end.

In one embodiment, lateral movement and rotation about a fixed pivot point 212, in response to movement of the vertical lift columns occurs. For example, as a vertical lift column is raised, a compression force is exerted, causing the rods to push or pull, depending on which lift column is engaged. Thus, one rod may move downward and rotate around the pivot point 212 as a result of the upward force exerted by the lift-column. Shown in FIG. 2C is an end view of one embodiment of the patient positioning system 200 in a lateral tilt of approximately 19 degrees. While it is not shown in the figures, it should be understood that the positioning system 200 is configured for lateral movement to occur in both directions—right and left—and depends on the movement of the vertical lift columns. FIG. 2D shows an interior view of the cross coupler and the position of the rods 216 as the positioning system is engages. When a lifting column is raised one rod moves further out of the coupler housing, while the opposing moves further into the housing of the coupler. This motion results in directional lateral movement of the interface and/or patient support assembly.

Patient Support Assembly:

The interface and patient support, when engaged, form a patient support assembly, shown in more detail in FIGS. 3 and 4. Turning to FIG. 3, the head end and foot end of interface 302 are shown in FIGS. 3A and 3B, respectively. The interface is comprised of a rigid frame, generally rectangular in shape, and being otherwise open to allow access of the patient from beneath the interface. The interface 302 is optionally configured with a track and/or rail (slider) system 304 coextensive with the outer edge of the interface 302. The track and/or rail system 304 allows longitudinal extension of the patient support assembly outward beyond the base of the table. FIGS. 3C and 3D, respectively, show another embodiment of the patient support assembly with patient support 306 engaged with the track and/or rail system 304.

In one embodiment, the patient support 306 is configured with a frame, comprising extension tubes 310 that engage and nest in one or more tracks and/or rails, 308 of the track and/or rail system 304. In one embodiment, the tracks are coextensive with the edges of the interface. The sliding mechanism, such as extension tubes 310, of the patient support is moveably connected and married with the reciprocal track 308 of the interface, when the patient support is attached to the interface. The extension tubes 310 move to permit the overall length of the patient support to expand or contract. FIG. 3 also shows a latch mechanism 314 for securing the patient support to the interface. In one embodiment, a latch assembly is located at each of the head end and foot end of the patient support assembly, however other latch arrangements can be configured, such as along the length of the support.

Figure 4A:
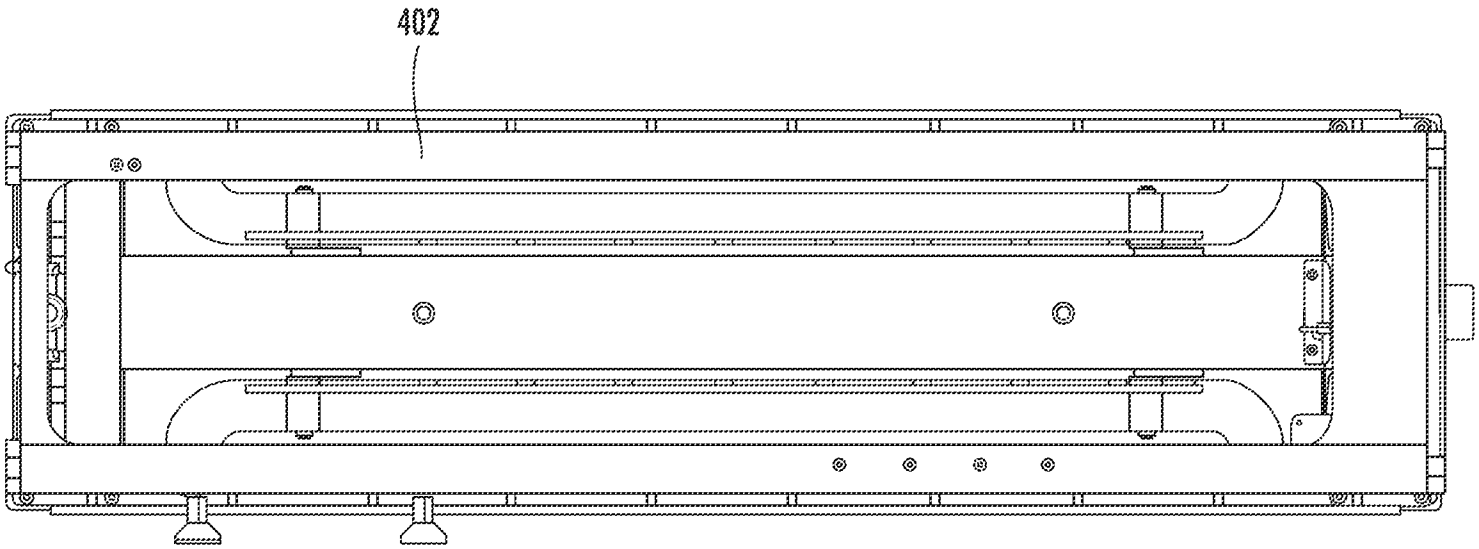
FIG. 4A shows a top-down view of one embodiment of the patient support 402, with the interface in the neutral position.
Figure 4B:
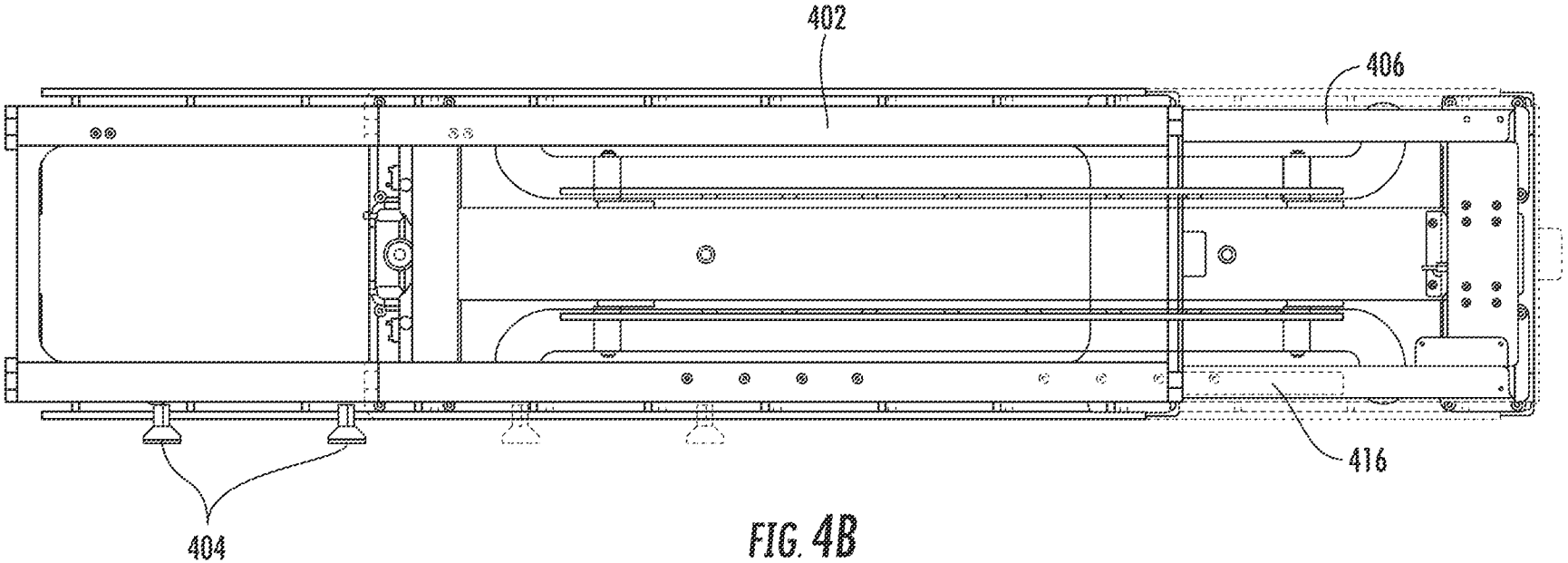
FIG. 4B shows a top-down view of one embodiment of the patient-support in the expanded-cantilever-position 404. Also shown in dashed lines to represent the interior of the interface frame is a piston 416, which powers the movement of the frame and/or platen 402 along the interface 406.

FIGS. 4A and 4B show the patient support assembly 402 in a stationary- or resting-position in which to receive a patient, and an outwardly extended-cantilever-position, whereby the extension of the patient support assembly 402 forms a cantilevered support 404. In one embodiment, the interface is configured with a linear actuator, such as a piston, shown in FIG. 4B. When engaged, the actuator facilitates movement of the patient support along the surface of the interface outward, away from the base of the table. In one embodiment, the interface can be extended from inches, up to two feet beyond the base of the table.

Figure 5:
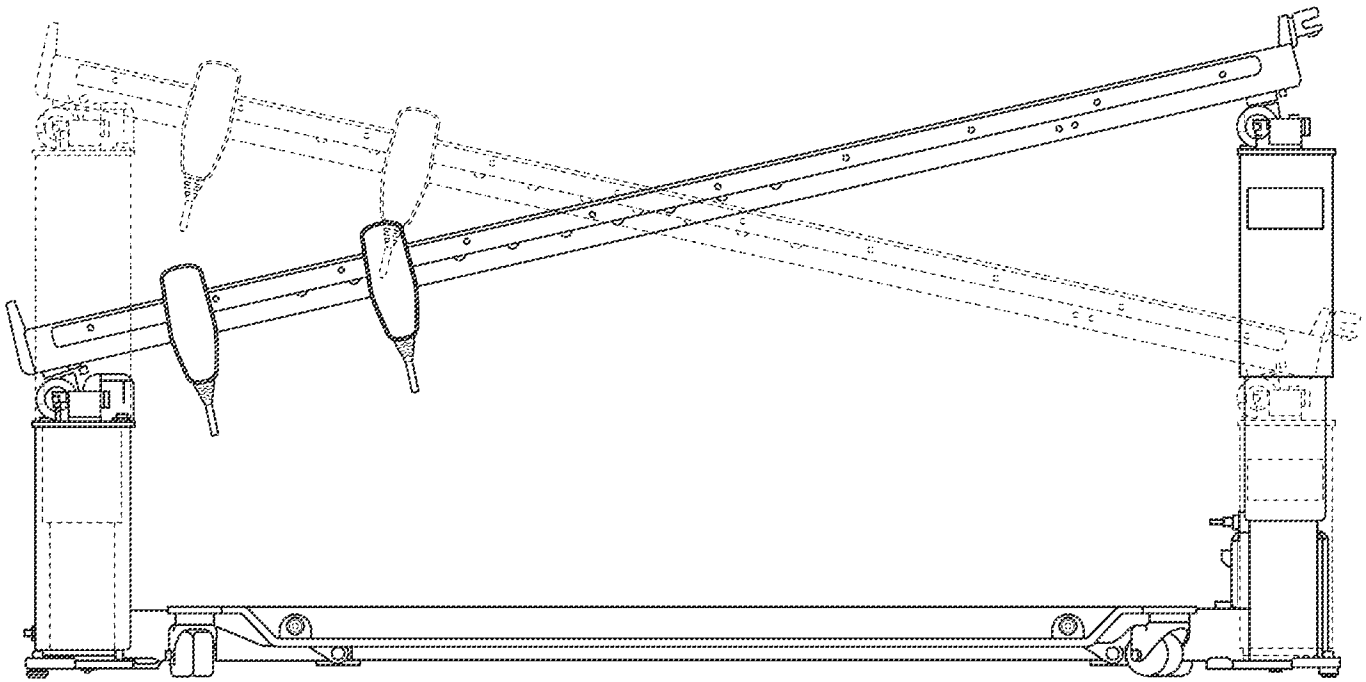
FIG. 5 shows a side perspective view of one embodiment of the patient-positioning apparatus in the Trendelenburg/Reverse position.

FIG. 5 shows example angled-positions of the patient support as depicted in FIG. 5, the surgical table can provide movement of the patient in any combination of lateral and vertical angles generally required for procedures or other medical reasons, such as Trendelenburg or Reverse-Trendelenburg.

Because the lifting mechanism of the table does not require use of lifting towers, there is unobstructed access to a patient's head, such as for administering anesthesia.

Figure 9:
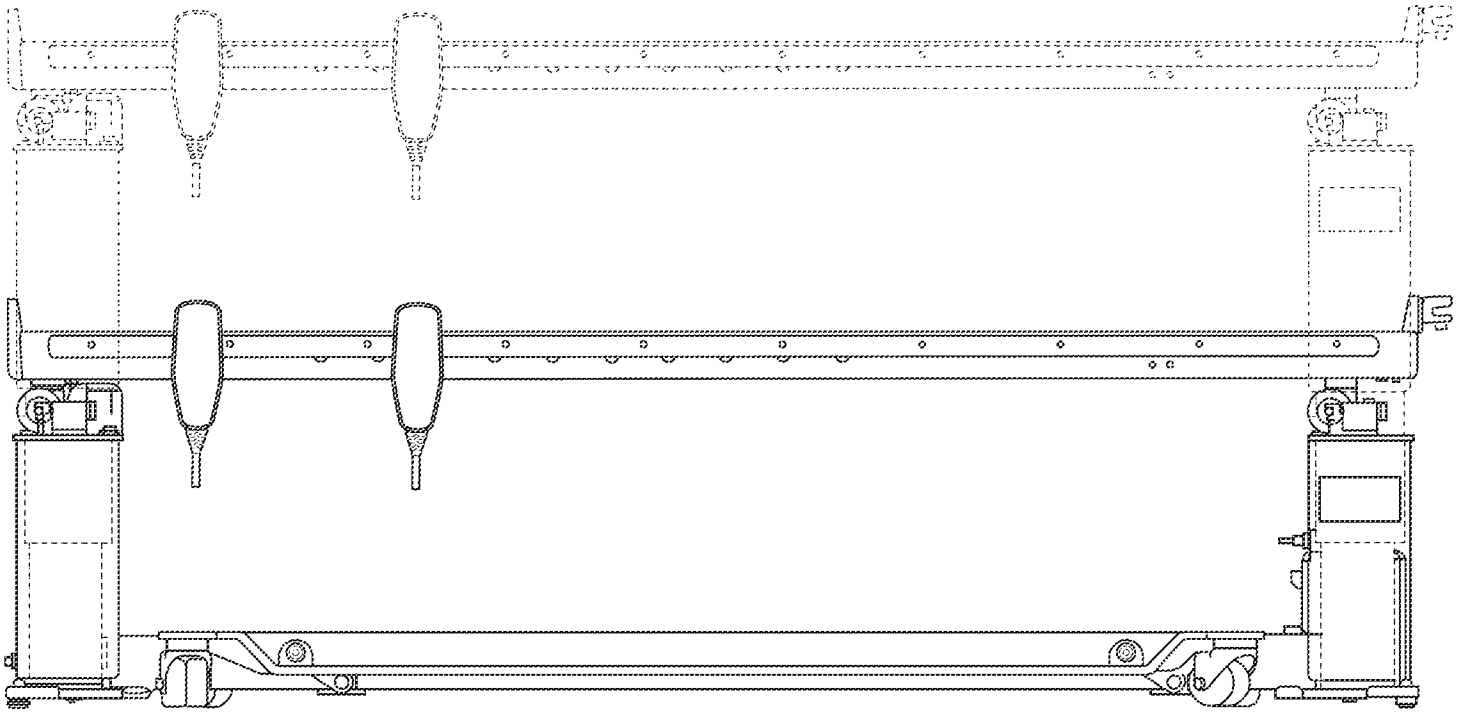
FIG. 9 shows a perspective view of the surgical apparatus in a lowered position (no extension of vertical lift columns) and extended position, with vertical lift columns in a fully-extended position.

Additionally, the table unit includes unobstructed-C-arm-access spacing for imaging. Overall, in one embodiment, the surgical table configured to be raised to a height up to 38 inches from the floor, from a resting position of approximately 22 inches from the floor, as shown in FIG. 9. These heights correspond to heights useful for medical procedures, but other minimum and maximum heights can be achieved.

Further, because the surgical table does not require rotational equipment for securing the lifting platens, the unit is generally more stable and resistive to vibration, shaking, and undesirable sudden movement during sensitive operations that can be catastrophic to the patient.

One or more safety belt system (not shown) is used to safely restrain a patient to the patient support. The arrangement and number of safety belt systems will depend on the arrangement of the patient support members, and the position of the patient. In one embodiment, the safety belt system is configured to attach to the patient support by means of a latch or groove.

In one embodiment, the apparatus is configured with one or more safety systems to prevent inadvertent movement of the positioning assembly or the lift-columns. In another embodiment, the apparatus is configured with a "lock-out" device that disengages all functional aspects of the table if elements are not properly aligned or in the proper position. The apparatus can also be configured with an alarm system that activates when a system malfunctions or when the system is not in proper alignment.

The warning can be visual or audible, or a combination. In one embodiment, accessories may be connected to the patient support assembly. For example, a traction device may be connected to a tube or rail system located at either head or foot end of the patient support assembly, or to the head or rear end of the interface. More specifically, a pulley-style system can be connected to the patient support system via a clamp, or other attachment means, such as a latch.

It is to be understood that the present invention is not limited to the embodiments described above, but encompasses any and all embodiments within the scope of the subjoined Claims and their equivalents.

What is claimed is:

1. An apparatus for positioning a patient for a surgical procedure, the apparatus comprising:

a base including vertical lifting-columns at each end of the base, each of the vertical lifting columns having a top end and a bottom end, the base having a first side and an opposite second side;

a patient-positioning system coupled to the top end of each vertical lifting-column;

a patient-support assembly including an operating platform including a head end and a foot end, and coupled to the patient-positioning system, the patient-positioning system connecting the patient-support assembly to the vertical lifting-columns;

the base including a first stabilizing bar attached to the first side of the base adjacent a lower portion of the base, and a second stabilizing bar attached to the second side of the base and adjacent the lower portion of the base, each of the stabilizing bars including a pair of casters with wheels connected to each of the casters;

wherein movement of the first stabilizing bar causes the wheels attached to the first stabilizing bar to move simultaneously;

wherein movement of the second stabilizing bar causes the wheels attached to the second stabilizing bar to move simultaneously;

wherein each of the stabilizing bars can be moved between a first position and a second position that is vertically higher than the first position, wherein each of the stabilizing bars can be locked in either the first or second position.

2. The apparatus of claim 1, wherein the stabilizing bars prevent the wheels from wobbling during repositioning of the stabilizing bars.

3. The apparatus of claim 1, wherein the stabilizing bars are connected via a mechanical link for coordinated movement.

4. The apparatus of claim 1, wherein lateral sides of the operating platform define a first width, and each of the casters are positioned within the first width when the stabilizing bars are in either the first position or the second position.

5. The apparatus of claim 1, wherein the stabilizing bars are positioned between the vertical lifting-columns.

6. The apparatus of claim 1, wherein the operating platform can be adjusted to various positions simultaneously including a lateral roll, Trendelenburg, reverse Trendelenburg, or a combination of lateral roll, Trendelenburg, and reverse Trendelenburg.

7. An apparatus for positioning a patient for a surgical procedure, the apparatus comprising:

a base including vertical lifting-columns at each end of the base, each of the vertical lifting columns having a top end and a bottom end, the base having a first side and an opposite second side;

a patient-positioning system coupled to the top end of each vertical lifting-column;

a patient-support assembly including an operating platform including a head end and a foot end, and coupled to the patient-positioning system, the patient-positioning system connecting the patient-support assembly to the vertical lifting-columns;

the base including a first stabilizing bar attached to the first side of the base adjacent a lower portion of the base, and a second stabilizing bar attached to the second side of the base and adjacent the lower portion of the base, each of the stabilizing bars including a pair of casters with wheels connected to each of the casters;

wherein movement of the first stabilizing bar causes the wheels attached to the first stabilizing bar to move simultaneously;

wherein movement of the second stabilizing bar causes the wheels attached to the second stabilizing bar to move simultaneously, wherein each stabilizing bar is movably connected to a central portion of the base, and each stabilizing bar is vertically movable by approximately a height of each of the casters.

* * * * *